United States Patent [19]

Goldring

[11] 3,982,283

[45] Sept. 28, 1976

[54] WATER CONSERVING DEVICE FOR FLUSHING APPARATUS

[75] Inventor: John E. Goldring, Pebble Beach, Calif.

[73] Assignee: Jegco, Inc., Pebble Beach, Calif.

[22] Filed: Apr. 7, 1975

[21] Appl. No.: 565,940

[52] U.S. Cl. ..... 4/67 A; 4/67 R; 4/57 P; 4/34

[51] Int. Cl.[2] ..... E03D 1/34

[58] Field of Search ..... 4/57 R, 57 P, 67 R, 4/67 A, 52, 55, 63, 37, 34, 61, 62

[56] References Cited

UNITED STATES PATENTS

| | | | |
|---|---|---|---|
| 1,667,990 | 5/1928 | Rogers | 4/67 R |
| 1,718,744 | 6/1929 | Koropczyk | 4/67 A |
| 2,168,742 | 8/1939 | O'Neill et al. | 4/57 |
| 2,214,439 | 9/1940 | Robertson | 4/56 |
| 2,514,062 | 7/1950 | Hoerig | 4/67 R |
| 3,036,313 | 5/1962 | Jenkins | 4/57 R |
| 3,345,648 | 10/1967 | Rafferty | 4/67 A |

*Primary Examiner*—Henry K. Artis
*Attorney, Agent, or Firm*—Harris Zimmerman

[57] ABSTRACT

A device for conserving water used in a conventional water closet comprises a heavy metal cylindrical disc having parallel opposed surfaces and an eccentrically disposed hole extending parallel to the axis. A slot extends radially from the exterior of the device to the hole, which has a smooth bore. The slot may be provided with one or more bosses and cooperating notches in the opposed faces thereof, to enhance the clamping action of the device. The device may be placed with the water closet tank ball valve stem extending normally through the slot, and secured thereon by crimping the device to close the slot faces together. Alternately, the flush valve stem may be disposed through the eccentric hole, and similarly secured by crimping. In a further embodiment the pull chain of a flapper valve may be secured in the device. The added weight of the device causes the flushing action to cease upon release of the flush handle, thereby reducing the amount of water consumed by the water closet.

6 Claims, 8 Drawing Figures

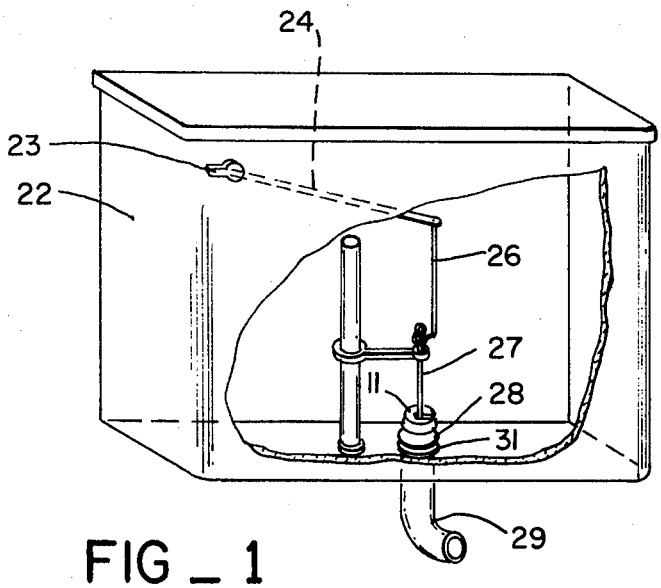
FIG _ 1
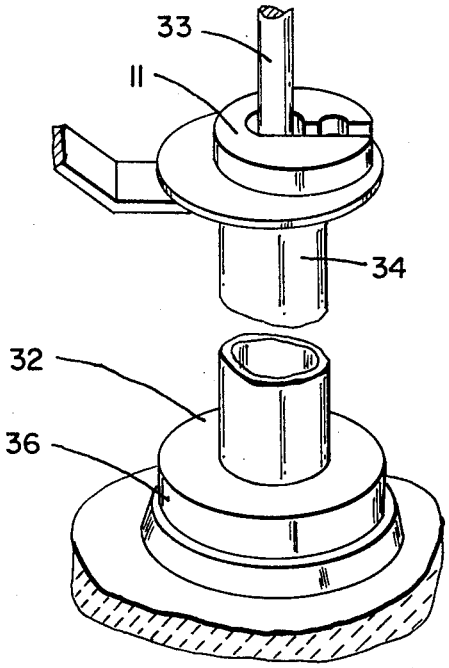
FIG _ 2
FIG _ 3
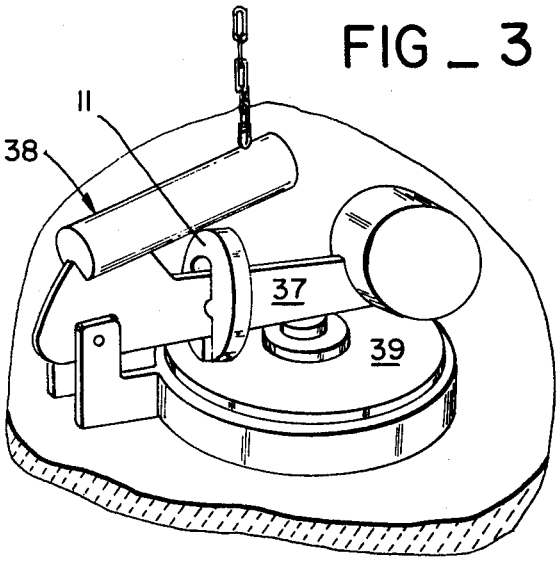
FIG _ 4
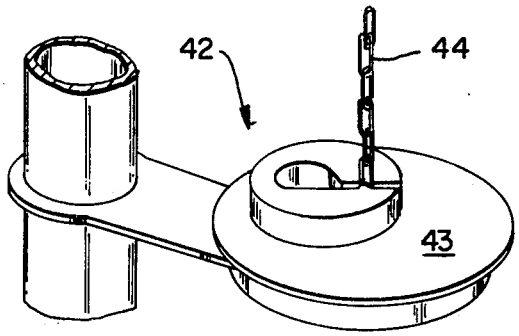
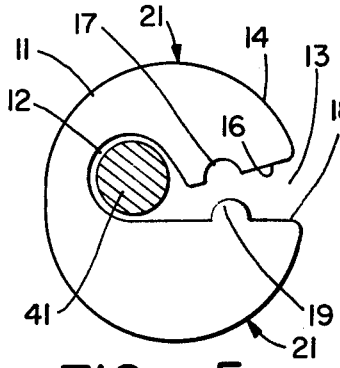
FIG _ 5
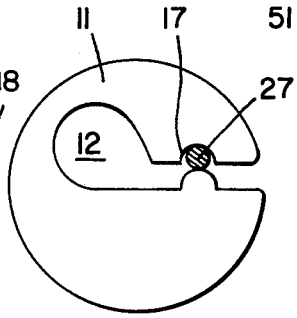
FIG _ 6
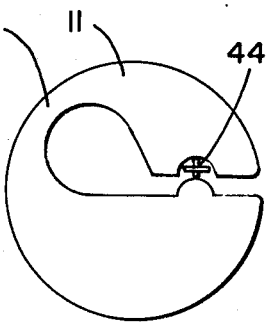
FIG _ 7
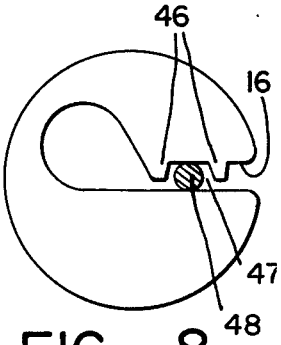
FIG _ 8

WATER CONSERVING DEVICE FOR FLUSHING APPARATUS

BACKGROUND OF THE INVENTION

A standard flush toilet in the United States disposes of approximately 3.5 gallons of fresh water in each flushing cycle. Although all of this amount of water is occasionally required to flush the waste out of the toilet bowl, most often a far smaller volume of water would suffice to accomplish the flushing task. Most toilets are arranged to use the entire water storage of the associated water closet once the operating lever is actuated. Thus, in considering a large number of flushing cycles in a typical toilet, a great amount of fresh water is wasted unnecessarily.

Such squandering of fresh water has been considered acceptable in the past, as supplies were considered to be virtually unlimited. However, the increasing scarcity of high quality water, especially in or near urban areas, has fostered a growing public concern for water conservation. Furthermore, changing meteorological patterns have cast doubt upon the longevity of established water supplies. It is also commonly recognized that the growing volume of raw sewage produced in urban areas in creating serious treatment and disposal problems. The deceptively simple step of reducing the amount of water used in existing flush toilets would significantly aid in alleviating these problems.

SUMMARY OF THE INVENTION

The present invention comprises a device adapted to modify any of the state of the art water closet toilet flush mechanisms so that the operator of the toilet may control the amount of water consumed in each flush cycle. That is, a toilet modified according to the present invention will draw water from the associated water closet only so long as the operating lever is actuated. Thus the amount of water consumed in each flush cycle may be selected by the operator according to need.

The invention comprises a cylindrical disc formed of a heavy metal, such as lead, which is provided with a smooth bore hole disposed eccentrically in the disc. A slot extends radially from the exterior of the disc to the hole. In one embodiment, the opposed sides of the slot are provided with a pair of cooperating grooves and bosses to permit the device to be clamped to the pull chain or pull rod of the flush mechanism. Alternatively a pair of spaced bosses may be provided on one side of the slot to effect a similar clamping action. The device is placed in the water closet with the existing valve stem or rod or pull chain extending through the eccentric hole or slot, as is dimensionally appropriate. The device is then crimped by manually squeezing the slot to clamp the device in place. The added weight of the device causes the flush valve to maintain a normally closed disposition unless the operating lever is maintained in the actuating position by the operator. Thus the amount of water drawn from the water closet storage capacity is directly related to the length of time the operating lever is actuated by the operator. That is, the amount of water consumed is directly selected by the operator according to the demands of the task.

THE DRAWING

FIG. 1 is a perspective view of the present invention employed in conjunction with one form of water closet flush mechanism.

FIG. 2 is a perspective view of the present invention employed in conjunction with another form of water closet flush mechanism.

FIG. 3 is a perspective view of the present invention used in connection with a further form of water closet flush mechanism.

FIG. 4 is a perspective view of the present invention secured to another form of water closet flush mechanism.

FIG. 5 is a top view of the present invention showing one manner of securing it to a flush mechanism.

FIG. 6 is a top view of the embodiment shown in FIG. 5, showing another manner of use thereof.

FIG. 7 is a depiction of the present invention showing a further manner of use thereof.

FIG. 8 is a top view of a further embodiment of the present invention.

DESCRIPTION OF THE PREFERRED EMBODIMENT

The present invention generally comprises a device adapted to modify a standard water closet flush toilet so that the automatic flush cycle which consumes the entire water closet supply is altered to become a semi-automatic cycle in which the amount of water drawn from the water closet is controlled by the individual flushing the toilet. As shown in FIG. 5, the device generally includes a cylindrical metal disk 11 formed of a heavy metal such as lead or ductile cast iron. The disk is provided with a hole 12 extending therethrough parallel to the axis of the cylinder and having a smooth, oval bore. As shown in the Figures, the hole 12 is eccentrically disposed in the disk.

The disk is also provided with a slot 13 extending radially from the exterior 14 of the disk to the hole 12. In the embodiment shown in FIGS. 5 – 7, the one internal face 16 of the slot is furnished with a groove 17 having a generally circular cross-section. The opposed slot face 18 includes a semi-circular boss 19 extending therefrom and disposed to be received in the groove 17. The hole, slot, groove, and boss are provided to afford a versatile clamping action so that the device may be secured to many different forms of flush mechanisms. Clamping is effected by manually squeezing the opposed sides of the device together, as shown by the arrows 21 in FIG. 5.

The present invention is intended to be secured to the outlet valve of an existing flush mechanism, so that the additional weight of the invention causes the outlet valve to maintain a normally closed disposition unless the operating lever is held in the operating position. Thus the outlet valve will no longer remain open while the entire water closet supply drains into the toilet bowl.

As shown in FIG. 1, a typical water closet 22 includes an operating handle 23 joined to an operating lever 24. The lever 24 is joined by a connecting rod 26 to the stem 27 of a typical tank ball valve 28. Normally during a flushing cycle the ball valve floats on the surface of the water in the water closet until the entire stored water supply drains out the exhaust pipe 29 and the ball can re-seat in the pipe opening 31. However, with the disk 11 secured to the valve stem the ball is provided with a negative buoyancy, so that the ball will re-seat whenever the handle is released. The disk is secured as shown in FIG. 6, with the valve stem 27 received in the groove 17, and held therein by the boss 19.

As shown in FIG. 2, the invention may be used in conjunction with another flush valve mechanism 32, identified as No. 3,055 and manufactured by American Standard, Inc. In this instance, the disk 11 slidably receives the guide rod 33 of the mechanism through the hole 12 and is crimped closed. The weight of the disk is transferred to the tube 34 of the valve 36 to achieve the same selective operation characteristics as previously described. In FIG. 3 the disk 11 is secured to the valve lever 37 of another common flush valve mechanism 38, identified as No. 5 and also manufactured by American Standard, Inc. In this instance the added weight of the disc, which receives the lever in the slot and hole, causes the valve 39 to remain closed unless continually actuated, as explained in the foregoing.

For those flush mechanisms which include a valve shank 41 of larger diameter, the invention may be employed as shown in FIG. 5. In such case the hole is first enlarged by applying pressure to the opposed faces of the slot, and the shank is placed in the hole. The disk is then crimped as before.

The invention may also be employed in conjunction with a flush valve mechanism 42 (FIG. 4), which employs a flapper valve 43. The pull chain 44 extending from the operating lever is received in the groove 17 and retained therein by the opposed boss, as shown in FIG. 7.

In a further embodiment of the invention, one face 16 of the slot is provided with a pair of spaced bosses 46, and the opposed face is smooth. The gap 47 between the bosses is employed to retain a pull chain or connecting rod 48 by crimping the slot faces together. It should be noted that the unique internal configuration of both embodiments of the present invention provide a diversity of ways in which the device can be mounted on various flush mechanisms, thereby having a wide-ranging application to most existing toilets. Obviously the device may also be installed in new water closet constructions.

It may be noted that the ductile material of the present invention is work hardened by the crimping process, especially in the region 51 of the disk. This hardening renders unauthorized removal of the device more difficult than expected.

I claim:

1. A water saving device for use in conjunction with a water closet buoyant flush valve, comprising a disk formed of a high specific gravity material and adapted to be secured to said flush valve to reduce the buoyancy thereof, said disk including a hole extending eccentrically therethrough and a slot extending generally radially from side hole to the periphery of said disk, said eccentric hole defining a weakened area in said disk whereby the disk may be deformed to selectively move the opposed surfaces of said slot from and toward each other.

2. The device of claim 1, wherein said slot includes a groove in one face thereof for receiving a portion of said flush valve, and a boss extending from the opposed face of said slot for retaining said valve portion in said groove.

3. The device of claim 1, wherein said slot includes a pair of spaced bosses in one face thereof defining a cavity therebetween for retaining a portion of said valve mechanism.

4. A water conserving device for use in conjunction with a water closet flush valve, comprising a disk formed of a high specific gravity, ductile material and adapted to be secured to said flush valve to reduce the buoyancy thereof, said disk including a hole extending centrally therethrough, and a slot extending from the exterior of said disk to said hole, said slot defining opposed sides of said disk adapted to be crimped together to retain a portion of said flush valve within said hole or said slot.

5. The device according to claim 4, wherein said slot includes a groove in one face thereof for receiving a portion of said flush valve, and a boss extending from the oppossed slot face of said slot for retaining said valve portion in said groove.

6. The device according to claim 4, wherein said slot includes a pair of spaced bosses in one face thereof defining a cavity therebetween for retaining a portion of said flush valve.

* * * * *

UNITED STATES PATENT OFFICE
CERTIFICATE OF CORRECTION

Patent No. 3,982,283 Dated September 28, 1976

Inventor(s) John E. Goldring

It is certified that error appears in the above-identified patent and that said Letters Patent are hereby corrected as shown below:

Column 4, line 11, "side" should read -- said --.

Signed and Sealed this

Sixteenth Day of May 1978

[SEAL]

*Attest:*

RUTH C. MASON
*Attesting Officer*

LUTRELLE F. PARKER
*Acting Commissioner of Patents and Trademarks*